United States Patent [19]

Fraser, Jr.

[11] 4,396,361

[45] Aug. 2, 1983

[54] SEPARATION OF LUBRICATING OIL FROM REFRIGERANT GAS IN A RECIPROCATING COMPRESSOR

[75] Inventor: Howard H. Fraser, Jr., Chittenango, N.Y.

[73] Assignee: Carrier Corporation, Syracuse, N.Y.

[21] Appl. No.: 7,865

[22] Filed: Jan. 31, 1979

[51] Int. Cl.[3] ..... F01C 1/16; F01C 21/06

[52] U.S. Cl. ..... 417/368; 417/419

[58] Field of Search ..... 417/371, 415, 419, 902, 417/370, 372, 368

[56] References Cited

U.S. PATENT DOCUMENTS

| | | | |
|---|---|---|---|
| 2,100,716 | 11/1937 | Lipman . | |
| 3,176,914 | 4/1965 | Rinehart . | |
| 3,334,808 | 8/1967 | Parker | 417/371 |
| 3,434,656 | 3/1969 | Bellmer . | |
| 3,663,127 | 5/1972 | Cheers | 417/372 |
| 3,781,138 | 12/1973 | Bellmer . | |
| 3,922,114 | 11/1975 | Hamilton | 417/372 |
| 4,181,474 | 1/1980 | Shaw | 417/902 |

*Primary Examiner*—Robert W. Jenkins

*Attorney, Agent, or Firm*—Donald F. Daley; David J. Zobkiw

[57] ABSTRACT

A hermetically sealed reciprocating motor compressor unit including a sealed shell. Discharge gas from the compressor is passed through the motor via suitable flow passages. The top of the motor and the interior surface of the shell define a chamber therebetween. The rotor functions as a centrifuge for separating the high pressure refrigerant gas from oil entrained therein. A substantially oil free vortex is formed encompassing a sector of the chamber defined by sides bearing 45° relative to the vertical center line of the rotor. A refrigerant gas discharge tube connected to the top of the shell is located at any position which falls within the sector defining the vortex.

2 Claims, 1 Drawing Figure

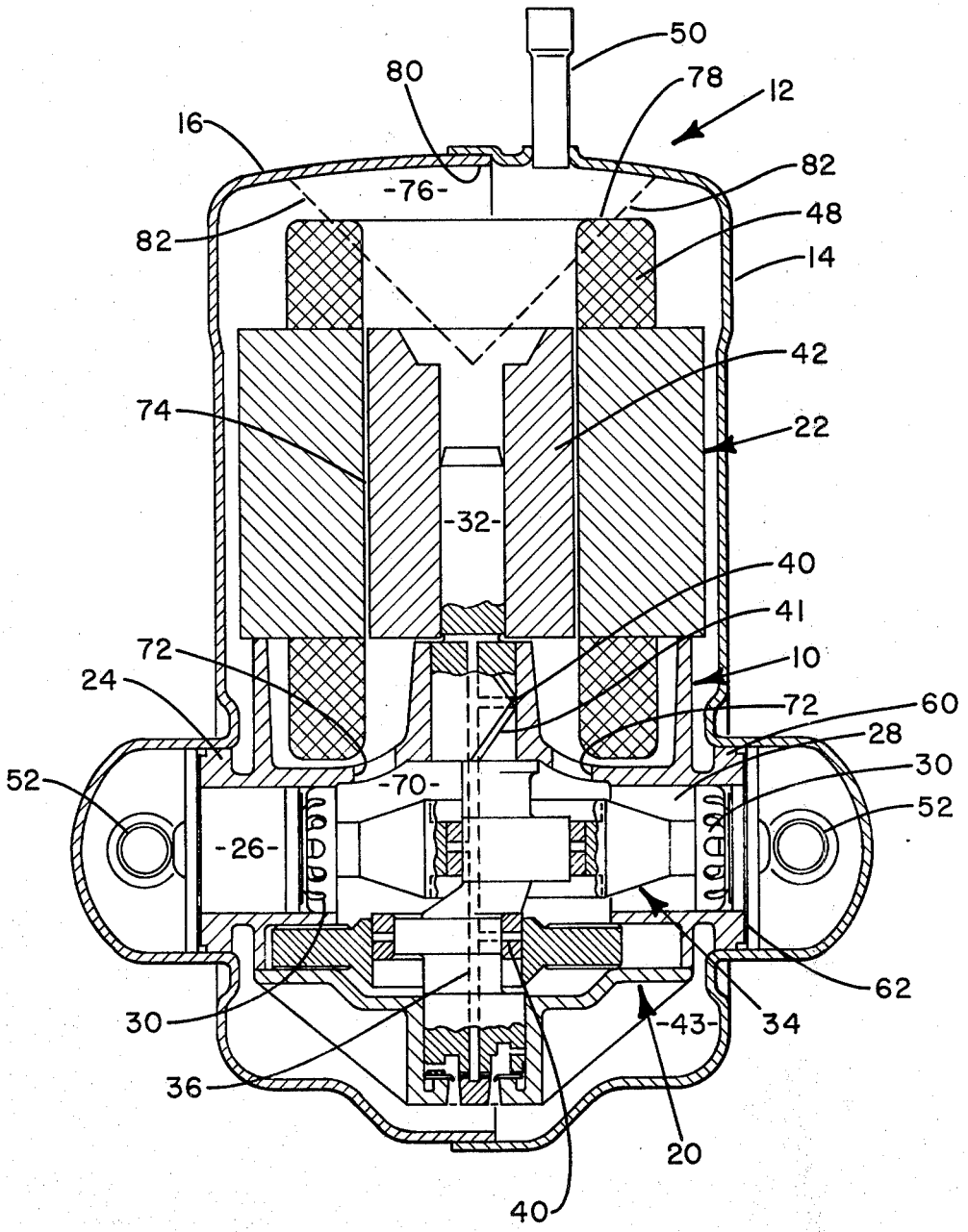
50
80
78
12
16
82
-76-
82
48
14
42
74
22
-32-
40
41
72
10
24
72
60
28
52
30
-70-
52
-26-
62
30
-43-
34
36
20
40

SEPARATION OF LUBRICATING OIL FROM REFRIGERANT GAS IN A RECIPROCATING COMPRESSOR

BACKGROUND OF THE INVENTION

This invention relates to a hermetically sealed reciprocating compressor and in particular to an arrangement whereby lubricating oil entrained within the refrigerant discharge gas is separated therefrom prior to the mixtures's exit through a discharge tube from the shell of the hermetically sealed compressor.

It has been found that significant increases in energy efficiency may be achieved in a hermetically sealed reciprocating compressor by eliminating the use of the suction gas to cool the motor windings prior to its entry into the compressor's cylinders. The superheating of the suction gas resulting from its use to cool the motor windings increases the amount of energy used by the compressor in compressing the refrigerant gas. Accordingly, it is desirable to utilize the discharge gas in lieu of the suction gas to achieve motor cooling and to prevent any heat transfer from the discharge gas to the suction gas.

One of the problems encountered in compressors utilizing discharge gas for motor cooling is the carry-over or entrainment of lubricating oil in the discharge gas. The entrained hot oil superheats the refrigerant gas and accumulates in the condenser and evaporator coils, reducing the capacity of the coil to transfer heat and reducing the mass flow rate of refrigerant through the coils. Both of the foregoing results of oil carry-over are adverse factors relative to energy efficiency of a refrigeration unit.

Heretofore, rotary compressors of various designs have employed discharge gas to cool the motor windings. It has been the common practice to use a rotating element, as for example a rotor plate attached to the motor's rotor or shaft, to achieve oil and refrigerant gas separation. Alternatively, baffle members have been employed to achieve separation. In either case, use has been made of the physical characteristic that refrigerant gas is relatively lighter than lubricating oil to achieve separation.

The present invention relates specifically to a hermetically sealed reciprocating compressor wherein separation of lubricating oil from the discharge gas is achieved without requiring the use of additional elements such as rotating plates or baffles.

SUMMARY OF THE INVENTION

Accordingly, it is an object of this invention to prevent excessive oil entrainment in the discharge gas exiting a hermetically sealed reciprocating compressor.

It is a further object of this invention to locate the discharge tube of a hermetically sealed refrigerant compressor at a predetermined location at the top of the hermetically sealed shell to minimize oil circulation from the compressor.

It is a further object of this invention to utilize an oil free vortex formed as a result of the centrifugal action of the rotor of a reciprocating motor compressor unit with the lighter refrigerant discharge gas remaining within the vortex and with the discharge tube being similarly disposed within the vortex.

These and other objects of the present invention are attained in a hermetically sealed reciprocating compressor which includes a sealed shell having an oil reservoir in the bottom thereof. The reciprocating compressor is mounted in the lower portion of the shell and has a drive motor connected thereto through a vertically disposed drive shaft. Suitable axial passages are formed in the drive shaft for conducting oil from the reservoir to the upper portions of the shaft to which the rotor of the motor is connected. Passage means are included for conducting discharge gas upwardly from the compressor through the motor. The top of the motor and the interior surface of the shell define a chamber. The rotor acts as a centrifuge for separating oil entrained in the discharge gas, with the heavier oil being thrown outwardly towards the sides of the shell and the lighter discharge gas passing upwardly within the chamber within a substantially oil free vortex encompassing a sector of the chamber defined by sides bearing 45° relative to the vertical center line of the motor's rotor. The discharge tube is connected to the top of the shell and opens thereinto for receiving discharge gas subsequent to its flow through the motor. The tube is located at any position at the top of the shell which falls within the sector defining the vortex.

BRIEF DESCRIPTION OF THE DRAWING

The single FIGURE of the drawing illustrates a longitudinal sectional view of a reciprocating motor compressor unit in accordance with the present invention.

DESCRIPTION OF THE PREFERRED EMBODIMENT

Referring now in particular to the single FIGURE of the drawing, there is disclosed a preferred embodiment of the present invention in which reference numeral 10 designates the motor compressor unit. Motor compressor unit is hermetically sealed within shell 12 which comprises first and second shell members respectively 14 and 16 connected together, as by welding, along a vertically extending circumferential seam.

Motor compressor unit 10 includes a reciprocating compressor portion generally designated 20 and a motor portion generally designated 22. Compressor portion 20 includes a cylinder block 24 defining first and second cylinders 26 and 28 in which pistons 30 are reciprocably movable. Pistons 30 are suitably connected to a vertically extending crankshaft 32 by a scotch yolk mechanism 34 of a type well known to those skilled in the art. Crankshaft 32 includes at least one vertically extending passageway 36 communicating with a plurality of radial and angularly inclined passageways 40 and 41. These passageways are provided for delivering oil from oil lubrication sump 43 defined by the lower interior surface of shells 14 and 16. Crankshaft 32 is connected to rotor 42 of motor 22. Motor 22 further includes stator 48.

A refrigerant gas discharge tube 50 is suitably attached at the top of the shell in the manner shown. Each cylinder is in fluid flow communication with a refrigerant tube 52 connected thereto to deliver suction gas into the cylinders for compression by operation of the pistons in a manner well known to those skilled in the art.

Wall or flange portions 60, extending from cylinder block 24, are in intimate engagement with the interior surface of shells 14 and 16, with the wall portion acting as a seal as described in copending application Ser. No. 007,866 filed, Jan. 31, 1979 in the names of John Jacobs and Gerhard Kuhn. In operation, refrigerant gas enters the cylinders under control of suction valve 62 supported on flange 60 and is compressed by operation of pistons 30. The cylinder gas flows upwardly from crankshaft chamber 70 through orifices 72 and thence through passageways 74 between rotor 42 and stator 48 to cool the motor windings. The refrigerant gas leaves the compressor via discharge tube 50. A space or chamber 76 is provided between the top surface of motor 22 and interior surface 80 of shell 12.

The lubricating oil is pumped upwardly through vertically extending passageway 36 which communicates as indicated previously with radial and angularly inclined passageways 40 and 41 to deliver lubricating oil to the various components of the compressor.

The refrigerant gas at discharge pressure flowing from chamber 70 through orifice 72 and passageway 74 entrains a considerable quantity of lubricating oil therewith. The entrained lubricating oil must be separated from the refrigerant gas before it leaves the compressor otherwise excessive oil carry-over will occur.

Heretofore, it has been the common practice to utilize rotating plates or other similar devices as centrifuges or separators to achieve lubricating oil separation. The present invention contemplates utilizing rotor 42 directly as a centrifuge. The rotor of motor 22 can be used as a centrifugal device to achieve the separation of the heavier lubricating oil from the lighter refrigerant gas as long as refrigerant discharge tube 50 is located at the top of hermetic shell 12 within a sector of chamber 76 defined by sides bearing 45° relative to the vertical center line of rotor 42. Dotted lines 82 represent the imaginary sides of the sector of chamber 76. As long as refrigerant discharge tube 50 is connected at the top of shell 12 within the sector defined by lines 82, the refrigerant delivered to the tube will be essentially oil free, as an oil free vortex is formed within the sector due to the centrifugal force generated by rotor 42. The separated oil is flung radially outward and gravitates back to lubricating oil sump 43. The refrigerant gas, being lighter than the lubricating oil, flows upwardly through chamber 76 and thence through discharge tube 50.

The present invention provides a unique lubricating oil system for a hermetically sealed reciprocating compressor of the type having refrigerant gas substantially filling the chamber defined by the shell in which the compressor is located.

While a preferred embodiment of the present invention has been described and illustrated, the invention should not be limited thereto but may be otherwise embodied within the scope of the following claims.

What is claimed is:

1. A method of operating a motor compressor unit having compressor means, an electric motor including a stator and a rotatable rotor located above the compressor means, and a shell encapsulating the compressor means and the electric motor, the method comprising the steps of:

rotating the rotor to drive the compressor means;

passing a vapor through the compressor means to compress the vapor;

passing lubricant through the compressor means to lubricate surfaces thereof, wherein lubricant becomes entrained in vapor;

conducting compressed vapor and lubricant entrained therewith upward between the stator and the rotating rotor, wherein the rotor throws the entrained lubricant radially outward, forming a substantially oil free space extending upward from the rotor to the top of the shell;

conducting compressed vapor from the top of the rotor in an unimpeded path directly upward through the oil free space to the top of the shell; and discharging substantially oil free compressed vapor from the oil free space through the top of the shell.

2. A motor compressor unit comprising:

compressor means for compressing a vapor;

motor means for driving the compressor means and including a rotatable rotor located thereabove;

a vertical drive shaft disposed substantially along the vertical centerline of the rotor and connecting the rotor and the compressor means;

a shell encapsulating the compressor and motor means;

a reservoir of lubricating oil located at the bottom of the shell;

means including an axial passage formed in the shaft for conducting oil from the reservoir to upper portions of the shaft;

passage means for conducting compressed vapor upward from the compressor means through the motor means wherein lubricant from the shaft becomes entrained with vapor conducted therepast, and wherein rotation of the rotor throws entrained lubricant radially outward, forming a substantially oil free space extending upward from the rotor;

a discharge tube extending through the top of the shell in communication with the oil free space for conducting vapor therefrom; and a substantially unrestricted vapor flow path extending upward within the oil free space from the top of the rotor to the discharge tube.

* * * * *